US005992827A

United States Patent [19]

Kvalsund

[11] Patent Number: 5,992,827

[45] Date of Patent: Nov. 30, 1999

[54] WINDING BLOCK

[75] Inventor: Bård Kvalsund, Ulsteinvik, Norway

[73] Assignee: Odim Holding A.S, Norway

[21] Appl. No.: 08/964,203

[22] Filed: Nov. 4, 1997

[30] Foreign Application Priority Data

Nov. 6, 1996 [NO] Norway ..... 964694

[51] Int. Cl.[6] ..... B66D 1/36

[52] U.S. Cl. ..... 254/398; 242/615.2

[58] Field of Search ..... 254/394, 398, 254/405, 407, 134.3 PA, 396, 397, 415; 242/615.3, 615.2; 226/189

[56] References Cited

U.S. PATENT DOCUMENTS

| | | | |
|---|---|---|---|
| 2,588,781 | 3/1952 | Venus | 254/134.3 PA |
| 2,946,559 | 7/1960 | Pickett | 254/134.3 PA |
| 3,110,479 | 11/1963 | Eitel | 254/134.3 PA |
| 3,145,016 | 8/1964 | Leithiser, Jr. | 254/398 |
| 3,618,899 | 11/1971 | Hancock | 254/396 |
| 3,871,621 | 3/1975 | Jackson | 254/134.3 PA |
| 4,417,718 | 11/1983 | Niskin | 254/415 |
| 4,708,321 | 11/1987 | Niskin | 254/405 |
| 5,725,200 | 3/1998 | Gordon | 254/398 |

*Primary Examiner*—Katherine A. Matecki
*Attorney, Agent, or Firm*—Pillsbury Madison & Sutro LLP

[57] ABSTRACT

A block for handling an elongate body such as a monitoring cable, comprising a plurality of wheels (5) having parallel axles (11) which, in an operational position, are arranged approximately perpendicular to the longitudinal direction of the block, wherein the axles (11) of the wheels (5) are mounted on arms (6) which are pivotally mounted in a shaft (4) which runs parallel to the longitudinal direction of the block.

17 Claims, 3 Drawing Sheets

WINDING BLOCK

The present invention relates to an improved winding block, a block used to reel seismic investigation monitoring cables onto winches on board a vessel.

Seismic investigation monitoring cables contain large amounts of sensitive measuring equipment, and the cables must therefore be treated as carefully as possible in order to avoid damage to this equipment during deployment and retrieval. Moreover, on the cable there are mounted some detachable and some non-detachable equipment which either cannot pass through the blocks used, or cannot stand the strain to which it is exposed when it passes through the block.

When, during retrieval, such non-detachable units are encountered, the cable must be lifted out of the block, the device moved past the block, and then the cable placed back in the block. Moreover, a monitoring cable typically contains about 30 depth controllers or "birds" which, when using today's block, must be detached before they reach the block. When one of these depth controllers is encountered, the hauling-in operation must be stopped, the block pulled onto the deck, the depth controller detached, and the block conveyed back to its normal position before the hauling-in operation can be restarted. Today, a boat typically has six to ten cables on board, and from time to time these must be hauled up. During certain periods the cable must be taken up after a few hours in the sea, whilst in other periods the cables may lie in the sea for several weeks consecutively. A pause in the hauling in of the cable for each unit of this kind either to detach the unit or to lift it past the block extends the deployment or hauling-in time of the cable considerably.

Thus, it would be desirable to be able to provide a block which makes possible a reduction in the time it takes to detach the detachable units, in addition to ensuring that the non-detachable units pass the block.

Another problem with today's blocks is the space between the wheels. The greater the space between the wheels, the greater the strain on the cable, and so on the monitoring equipment therein during the hauling-in operation. Today, attempts are made to solve this problem by placing a belt of some kind between the wheels in order to obviate uneven motion. However, this is an expensive, complex and incomplete solution to the problem.

SUMMARY OF THE INVENTION

The objective of the present invention is to provide an improved winding block which overcomes the aforementioned problems in a manner superior to that achieved according to the prior art.

According to the present invention, an attempt is made to solve this problem by means of a block for handling an elongate body such as a monitoring cable, comprising a plurality of wheels having parallel axles which, in an operational position, are arranged approximately perpendicular to the longitudinal direction of the block, where the wheels axles are mounted on arms which are pivotally mounted in a shaft running parallel to the longitudinal direction of the block.

In comparison with the prior art, the present winding block has the advantage that the space between the wheels has been reduced considerably without reducing the cable-guiding outer edge of the wheels, thereby giving a more even and more exact motion of the cable through the block than the conventional solutions without the use of a belt or the like, and also that the block can simply and readily be opened by means of remote control, so that non-detachable and detachable equipment on the cable, which cannot pass through the block, can be lifted past the block when this is open, and that the block can easily be closed again once this equipment has been taken past. The detachable units can thus be detached when they have reached the deck without the block having to be moved onto the deck.

BRIEF DESCRIPTION OF THE DRAWINGS

The invention will now be described with reference to the appended figures, wherein.

DETAILED DESCRIPTION OF THE INVENTION

Figure 1:
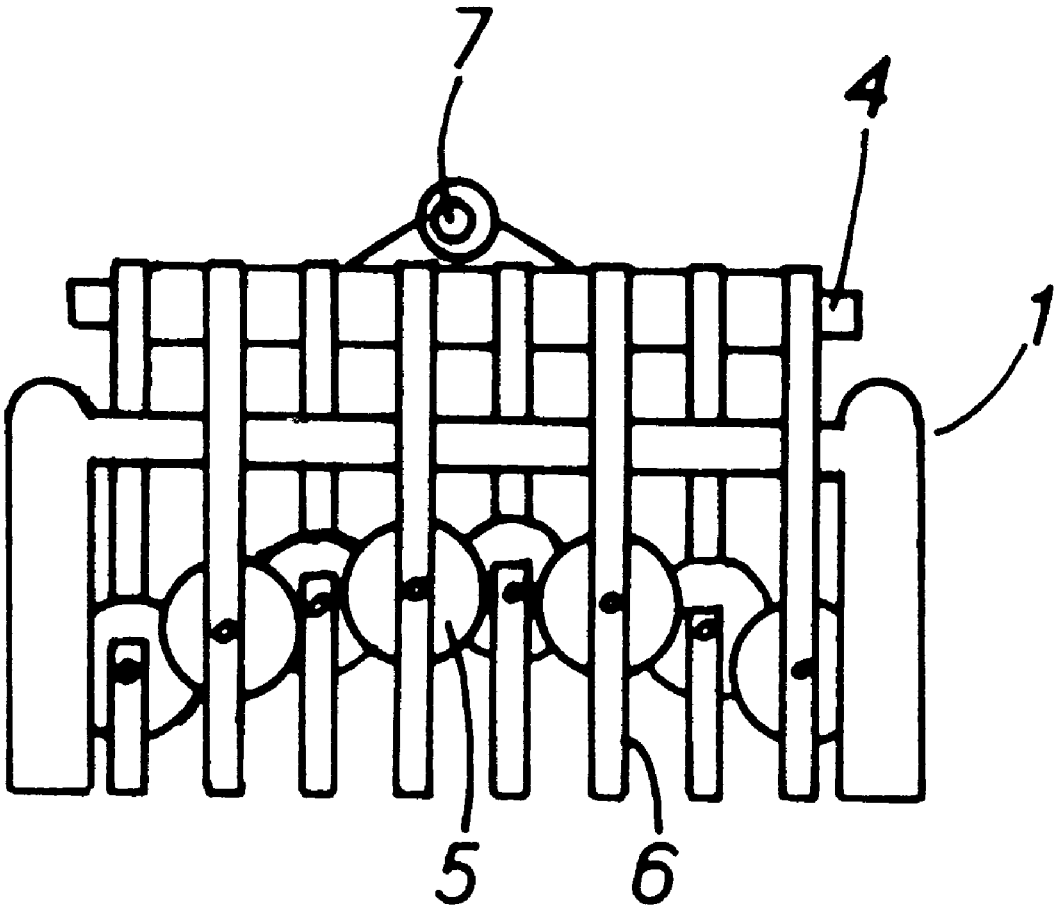
FIG. 1 is a partially cut away side view of an embodiment of the present winding block.
Figure 2:
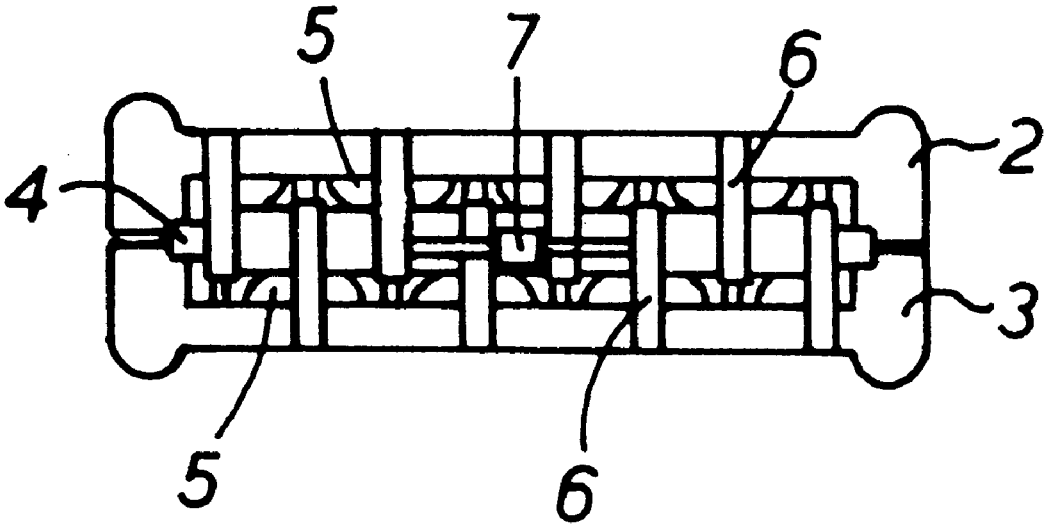
FIG. 2 is top view of the same embodiment as in FIG. 1.

The figures show a, for the time being, preferred embodiment of the present block. FIG. 1 is a side view of the block, and shows a plurality of wheels 5, positioned on arms 6. The arms 6 are pivotally mounted in a shaft 4, which is turn is mounted in the top hinge 7 of the block. The arms 6 run from the shaft 4 towards one side or the other of the block, and are mounted so that every other arm goes to one side and every other arm goes to the other side, as is shown in FIG. 2. The illustrated block has eight wheels having eight associated arms 6, i.e., four arms to each side of the block. However, the number of wheels 5 and associated arms 6 may depart from this number, and in the majority of cases it will be preferable to have five to ten wheels. The arms 6 on either side are connected to each other in their respective part of a frame 1, viz., the frame parts 2 and 3, respectively. The frame parts 2 and 3 form at the front edge and the rear edge of the block, respectively, a frame around the monitoring cable inlet and the monitoring cable outlet, respectively.

Conventionally, the wheels in blocks of this kind are greater in diameter along the lateral edges than in the middle in order to centre the cable on the wheels and prevent migration of the cable from side to side on the wheel. In the case of a traditional block, it is this greater diameter along the lateral edges which determines the smallest space between the wheels in the block. There must be sufficient space between the wheels to prevent them from touching one another during rotation.

Figure 3:
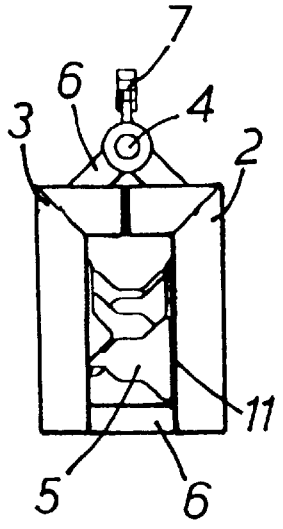
FIG. 3 is a view from one end face of the same embodiment as in FIG. 1.

To reduce the space between the wheels, each wheel has increased diameter relative to the diameter along one lateral edge of the wheel, but reduced diameter along the other lateral edge. By placing the wheels on a parallel axis, alternate wheels in opposite directions, the wheels, as can be seen in FIG. 2, may be spaced apart at a distance corresponding to the diameter along one of the lateral edges, plus the diameter along the other lateral edge, plus a safety margin. As can be seen in FIG. 3, the sum of these wheels will give a steering which will centre the cable in the block and prevent the migration thereof, in the same way as with a traditional wheel, whilst obtaining a space between the wheels which gives a more even and safer motion and also less physical strain on the monitoring cable as it is hauled in.

Figure 4:
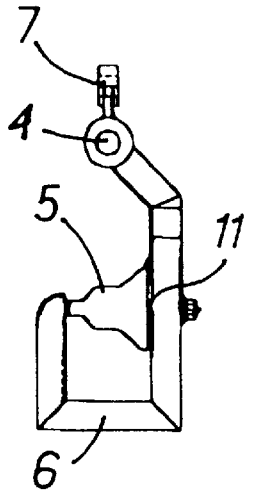
FIG. 4 shows, from one end face, how the block can be opened.

Each arm 6 is approximately J-shaped, as shown in FIG. 4. Uppermost, the arm 6 is swung inwards towards the "centre line" of the J and is suspended in the shaft 4. The wheel 5 is mounted on an axle 11 which is suspended in two points on the J-shaped arm 6, viz., approximately uppermost on the short arm of the J and also at a corresponding level on the long part of the J, thereby obtaining a strong suspension which can stand great strain.

Figure 5:
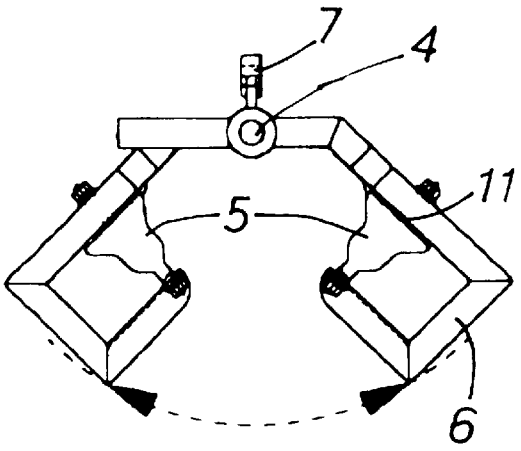
FIG. 5 is a section of a wheel suspension arm and a wheel seen from one end face of the block.
Figure 6:
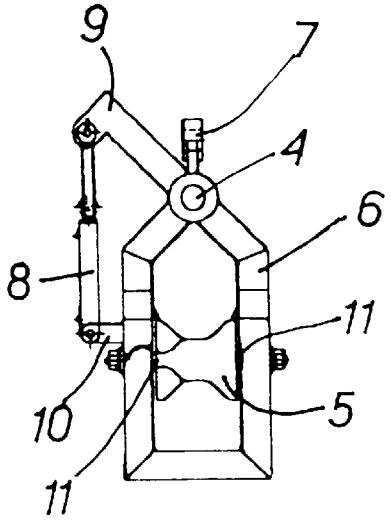
FIG. 6 shows, from one end face, the present block with a hydraulic cylinder for opening the block.

When the block is to be opened, the arms interconnected with the frame parts 2, 3, respectively, are pivoted out, each to its respective side, as shown in FIG. 5. The block is opened thus so that the monitoring cable can run out freely under the block. Of course, the block can be opened manually, but is preferably opened using remote control, for example, as shown in FIG. 6, where one of the arms 6 on one side of the block is extended beyond the shaft 4, and whereupon this extension 9 is secured to a hydraulic cylinder 8. The other side of the hydraulic cylinder 8 is secured to a point of attachment 10 on the arm 6 on the opposite side of the block. Thus, the block can be opened or closed with the aid of this hydraulic cylinder 8. This allows the block to be opened and closed by a person standing at a safe distance and reduces the need for operations which are time-consuming and/or expose personnel to danger.

Of course, the hydraulic cylinder 8 may also be placed on the block in another manner and may also be replaced by other means for opening and closing such as, e.g., an electric motor or the like.

The new design, where the block opens downwards, in contrast to earlier blocks which are opened by a cover on the top of the block being opened and the monitoring cable being moved out therethrough, also allows a shorter pendulum arm between suspension 7 and the cable which runs through the block. This short pendulum arm is important to obtain minimum lateral force when the block swings. With a suspension as shown in the figures, swinging in two directions with the short pendulum arm will be obtained, which makes possible the necessary mobility of the block, whilst the lateral force is kept to a minimum.

In an alternative embodiment of the present block, the block can be made lighter by removing the lowermost part of the J-shaped arm, i.e., the part below the attachment for the wheel axle 11. In an open position, the axle 11 on the side of the wheels 5 which is thinnest, will hang free. When the block is folded together and closed, this free-hanging axle will engage with a non-illustrated mounting plate which extends between the arms 6 on the opposite side of the block.

Having described my invention, I claim:

1. A winding block, comprising a first frame;

a plurality of wheels, each having a rotating axis and being rotatably mounted to the first frame about their rotating axes on a first side of a longitudinal axis of the winding block;

a second frame, at least one wheel having a rotating axis and being rotatably mounted to the second frame about the rotating axis on an opposing side of the longitudinal axis to the wheels mounted to the first frame;

a pivot mounted between the frames so that at least one of the frames can be pivoted with respect to the other of the frames between a closed cable supporting position and an open cable disengaging position the at least one wheel of the second frame being interspersed between the first frame wheels in the closed cable supporting position.

2. A winding block as in claim 1, wherein the second frame includes a plurality of wheels, each having a rotating axis and being rotatably mounted to the second frame about their respective rotating axes on the opposing side of the longitudinal axis to the wheels mounted to the first frame.

3. A winding block as in claim 2, wherein each frame includes an extending arm for each wheel and to which each wheel is mounted.

4. A winding block as in claim 3, wherein each of the wheel rotating axes of each frame are substantially parallel to each other.

5. A winding block as in claim 4, wherein each wheel includes a center portion, a first lateral portion connected to one side of the center portion and having a diameter greater than the center portion, and a second lateral portion connected to an opposite side of the center portion and having a diameter smaller than the center portion.

6. A winding block as in claim 5, wherein the second lateral portions of the wheels mounted to the first frame are positioned adjacent the first lateral portions of the wheels mounted to the second frame when the frames are in the closed cable supporting position.

7. A winding block as in claim 6, wherein the center portion of each wheel is generally cylindrical.

8. A winding block as in claim 7, and further comprising a remotely controlled actuator connected between the two frames to pivot the frames between the closed cable supporting position and the open cable disengaging position.

9. A winding block as in claim 8, wherein the rotating axes of the wheels are generally perpendicular to a longitudinal axis of the winding block.

10. A winding block as in claim 2, wherein a center portion of each wheel is generally cylindrical.

11. A winding block as in claim 1, wherein each frame includes an extending arm for each wheel and to which each wheel is mounted.

12. A winding block as in claim 11, wherein each of the wheel rotating axes of each frame are substantially parallel to each other.

13. A winding block as in claim 12, wherein each wheel includes a center portion, a first lateral portion connected to one side of the center portion and having a diameter greater than the center portion, and a second lateral portion connected to an opposite side of the center portion and having a diameter smaller than the center portion.

14. A winding block as in claim 13, wherein the second lateral portion of the wheel mounted to the first frame is positioned adjacent the first lateral portion of the wheel mounted to the second frame when the frames are in the closed cable supporting position.

15. A winding block as in claim 14, wherein the center portion of each wheel is generally cylindrical.

16. A winding block as in claim 1, wherein a center portion of each wheel is generally cylindrical.

17. A winding block as in claim 1, wherein the rotating axes of the wheels are generally perpendicular to a longitudinal axis of the winding block.

* * * * *